US009979134B2

(12) United States Patent
Yu et al.

(10) Patent No.: US 9,979,134 B2
(45) Date of Patent: May 22, 2018

(54) ELECTRICAL CONNECTOR WITH IMPROVED SHIELDING PERFORMANCE

(71) Applicant: FOXCONN INTERCONNECT TECHNOLOGY LIMITED, Grand Cayman (KY)

(72) Inventors: Chun-Ming Yu, Kunshan (CN); Juan Du, Kunshan (CN); Guo-Hua Zhang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/161,290

(22) Filed: May 23, 2016

(65) Prior Publication Data

US 2016/0352052 A1 Dec. 1, 2016

(30) Foreign Application Priority Data

May 29, 2015 (CN) ..... 2015 2 0358658 U

(51) Int. Cl.

| | |
|---|---|
| ***H01R 13/648*** | (2006.01) |
| ***H01R 13/6594*** | (2011.01) |
| ***H01R 13/6585*** | (2011.01) |
| *H01R 13/64* | (2006.01) |
| *H01R 13/6466* | (2011.01) |

(Continued)

(52) U.S. Cl.

CPC ..... *H01R 13/6594* (2013.01); *H01R 13/6585* (2013.01); *H01R 13/64* (2013.01); *H01R 13/648* (2013.01); *H01R 13/6466* (2013.01); *H01R 13/6581* (2013.01); *H01R 13/6587* (2013.01);

(Continued)

(58) Field of Classification Search

CPC .... H01R 13/64; H01R 13/6466; H01R 23/02; H01R 13/648; H01R 13/6581; H01R 13/6594; H01R 13/6587; H01R 23/6873; H01R 23/7073

USPC .... 439/660, 607.01, 607.07, 607.09, 607.11, 439/607.4, 676

See application file for complete search history.

(56) References Cited

U.S. PATENT DOCUMENTS

| | | | | |
|---|---|---|---|---|
| 8,460,036 B1 * | 6/2013 | Chen | H01R 13/6581 | 439/660 |
| 2015/0044886 A1 * | 2/2015 | Little | H01R 12/75 | 439/55 |

(Continued)

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector includes an insulating housing, contacts, a shielding plate disposed in the housing and a metallic shell. The housing includes a base and a mating tongue, the base includes a retaining portion and a supporting portion extending downwards beyond the retaining portion. The contacts have contacting portions exposing to the mating surface and legs extending downwards from the supporting portion. The shielding plate defines a pair of side latches thereof. The metallic shell is retained on the retaining portion of the base and surrounds the mating tongue to define a mating cavity between the shell and the mating tongue. The connector further includes a front shielding member covering a front face of the supporting portion and a rear shielding member covering on a rear face of the supporting portion for shielding the legs of the contacts in a front and rear direction.

20 Claims, 7 Drawing Sheets

(51) Int. Cl.

| | |
|---|---|
| *H01R 24/00* | (2011.01) |
| *H01R 13/6587* | (2011.01) |
| *H01R 12/50* | (2011.01) |
| *H01R 13/6581* | (2011.01) |

(52) U.S. Cl.
CPC ..... *H01R 23/02* (2013.01); *H01R 23/6873* (2013.01); *H01R 23/7073* (2013.01)

(56) References Cited

U.S. PATENT DOCUMENTS

| | | | | |
|---|---|---|---|---|
| 2015/0200504 | A1* | 7/2015 | Little | H01R 24/60 439/345 |
| 2016/0118752 | A1 | 4/2016 | Guo et al. | |
| 2016/0329645 | A1* | 11/2016 | Tsai | H01R 13/6595 |
| 2017/0054258 | A1* | 2/2017 | Little | H01R 24/60 |

* cited by examiner

ELECTRICAL CONNECTOR WITH IMPROVED SHIELDING PERFORMANCE

BACKGROUND OF THE INVENTION

1. Field of the Invention

The present invention generally relates to an electrical connector with improved shielding performance.

2. Description of the Related Art

USB 3.0 Promoter Group issued a new specification which established a new type connector named as USB Type-C Cable and Connector, on Aug. 11, 2014. In the specification, the Type-C plug enhances ease of use by being plug-able in either upside-up or upside-down directions. The receptacle connector has more elements and has smaller, thinner size. Hence, an improved electrical connector is desired, especially to mass product.

In USB Type C revision 1.0, a USB Type-C Hybrid Right-Angle Receptacle is shown in page 36 and 38. The high transmission speed is up to 10 Gpbs at each channel and the shielding performance of the receptacle is an importance issue.

In view of the above, an improved electrical connector is desired to overcome the problems mentioned above.

BRIEF SUMMARY OF THE INVENTION

Therefore, an object of the present invention is to provide an electrical connector with an improved shielding performance.

To fulfill the above-mentioned object, an electrical connector comprises an insulating housing comprising a base and a mating tongue extending from the base, the mating tongue defining two opposite mating surfaces, the base comprises a retaining portion and a supporting portion extending downwards beyond the retaining portion, the supporting portion defining a front face and a rear face; a plurality of contacts with contacting portions exposing to the mating surface and legs extending downwards from the supporting portion; a shielding plate disposed in the insulating housing and between the two mating surfaces, the shielding plate defines a pair of side latches thereof; a metallic shell retained on the retaining portion of the base and surrounding the mating tongue to define a mating cavity between the metallic shell and the mating tongue. The electrical connector further comprises a front shielding member covering the front face of the supporting portion and a rear shielding member covering on the rear face of the supporting portion for shielding the legs of the contacts in a front and rear direction.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
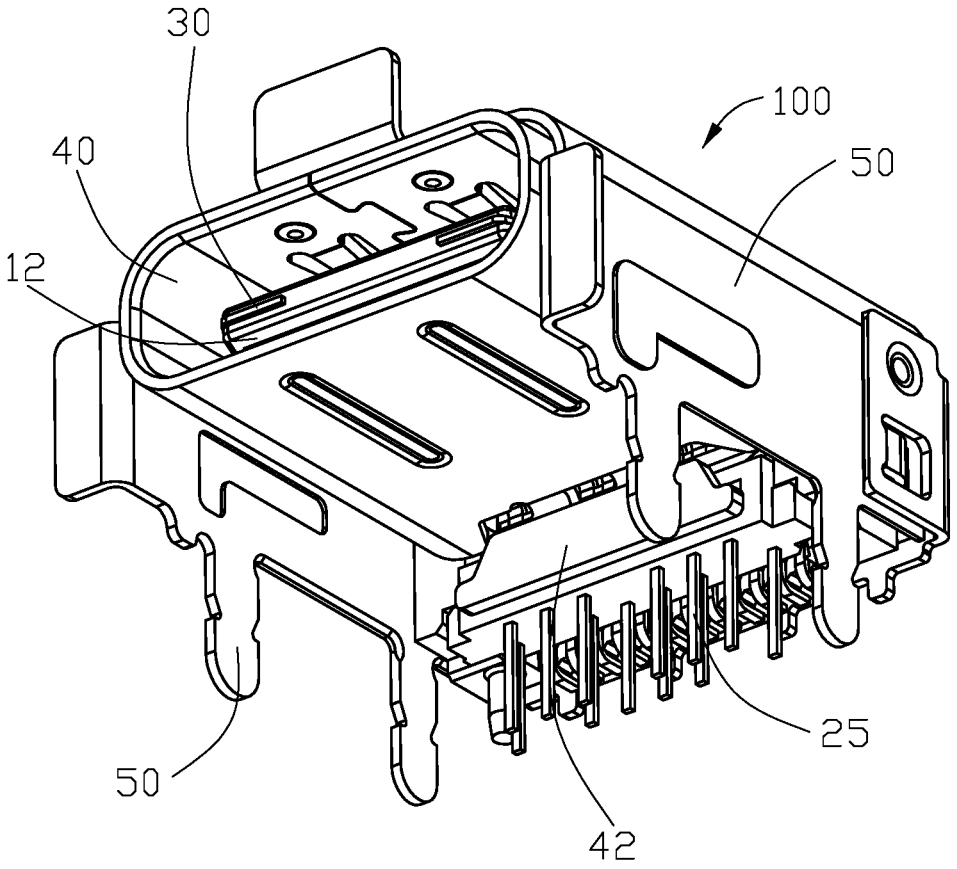
FIG. 1 is a front and bottom perspective view of an electrical connector made in accordance with the present invention.
Figure 2:
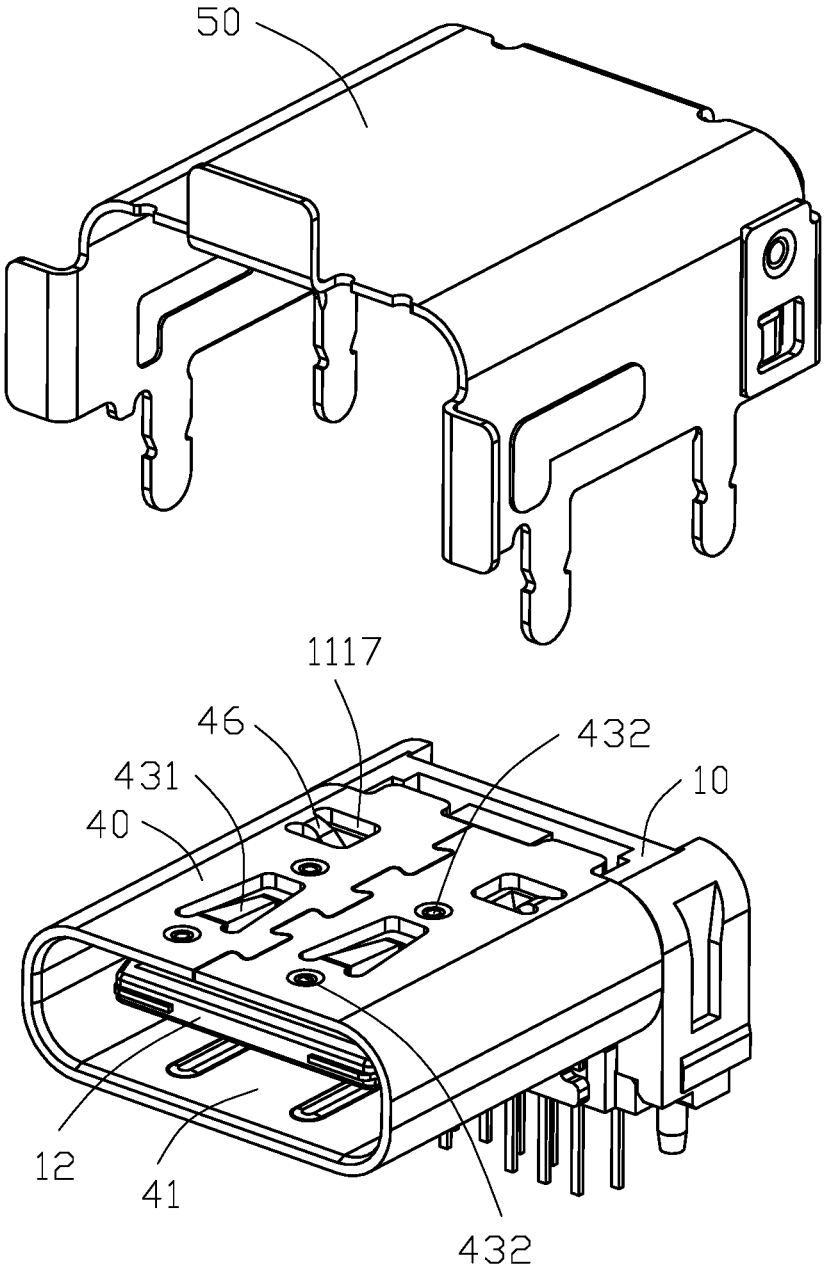
FIG. 2 is a top and front exploded perspective view of the electrical connector in FIG. 1.

Referring to FIG. 1, an electrical connector 100 of the preferred embodiment of the present invention is a high profile USB Type C connector which is intended to be mounted on a printed circuit board (PCB, not shown), that means a front mating port separates from the PCB with a larger gap. Combination with FIGS. 2-4, the electrical connector 100 includes an insulating housing 10, a plurality of contacts 21, 22, a shielding plate 30, a metallic shell 40 and a metallic bracket 50. The insulating housing 10, the contacts 21, 22 and the shielding plate 30 are molded together to form a terminal module 101, the metallic shell 40 and the metallic bracket 50 surround the terminal module 101 for EMI (electromagnetic interference) protection. The terminal module 101 are formed by two insert-molding processes, that is, two terminal sub-modules formed by a first insert-molding process respectively, are sandwiched with a shielding plate or a shielding plate module, and then an insulating outer are formed on the sub-modules by a second insert-molding process thereby forming the terminal module 101. The insulating housing 10 includes a base 11 and a mating tongue 12 integrally extending from the base 11. The metallic shell 40 is retained on the base 11 and surrounding the mating tongue 12 to define a mating cavity 41. The base 11 includes a front retaining portion 111 behind the mating tongue 12 and a supporting portion 112 behind the retaining portion 111, the supporting portion 112 extends downwards beyond the retaining portion 111. The supporting portion 112 defines a front face 1121 and a rear face 1122 opposite to the front face 1121. The mating tongue 12 defines a step root 124 near to the base, which is thickener and wider than the front porting of the mating tongue 12. The step root 124 can be disposed with a grounding collar (not shown) in other embodiment.

The metallic shell 40 includes a top wall 411, a bottom wall 412 and two sidewalls 413 and a rear wall 42, the rear wall 42 bends downwards from a rear edge of the bottom wall 412. The metallic shell 40 has a rear area retained on the retaining portion 111 of the base, the rear area defines two tabs 46 laterally extend into recesses 1117 defined on the retaining portion 111 The rear wall 42 covers the front face 1121 of the supporting portion 112. The metallic bracket 50 covers on the metallic shell 40 and includes a rear wall 52 covering the rear face 1122 of the base. The rear walls 42, 52 shield the legs 25 of the contacts 21, 22 in a front and rear direction collectively. Therefore, the rear wall 42 is defined as a front shielding member 42' and the rear wall 52 is defined as a rear shielding member 52'. Alternatively, the front shielding member 42' and the rear shielding member 52' can be formed discretely from the shell 40 or the bracket 50, or formed by other conductive materials.

The top wall 411 of the metallic shell 40 defines spring fingers 431 slantwise extending rearwards into the mating cavity 41. The top wall 411 defines two protruding dimples 432 at a front point and a rear point of the spring finger 431 respectively. The bottom wall 412 defines two protruding ribs 433 into the mating cavity 41, the protruding ribs 433 are arranged parallel to each other and each extending along the front and rear direction. The protruding dimples 432 and the protruding ribs 433 not only benefit an engagement of the electrical connector with a plug connector inserted in the mating cavity 401, but also enlarge an intensity of the metallic shell 40.

The metallic bracket 50 includes a top wall 511 and two sidewalls 512 perpendicularly bending from the top wall 511. The front edge of each of the top wall 511 and sidewalls 512 defines a pressing piece 53 perpendicularly bending therefrom. Two mounting legs 541 extend downwards from each sidewall 512. A plurality of pressing legs 542 extend downwards from the rear wall 52. Two retaining flat 55 bend forwards and abut against the sidewalls 512, respectively. The retaining flat 55 defines a tab 551 extending rearwards and inwards to press against the sidewall 512 and a laser-welding dimple 552 above the tab 551.

Figure 3:
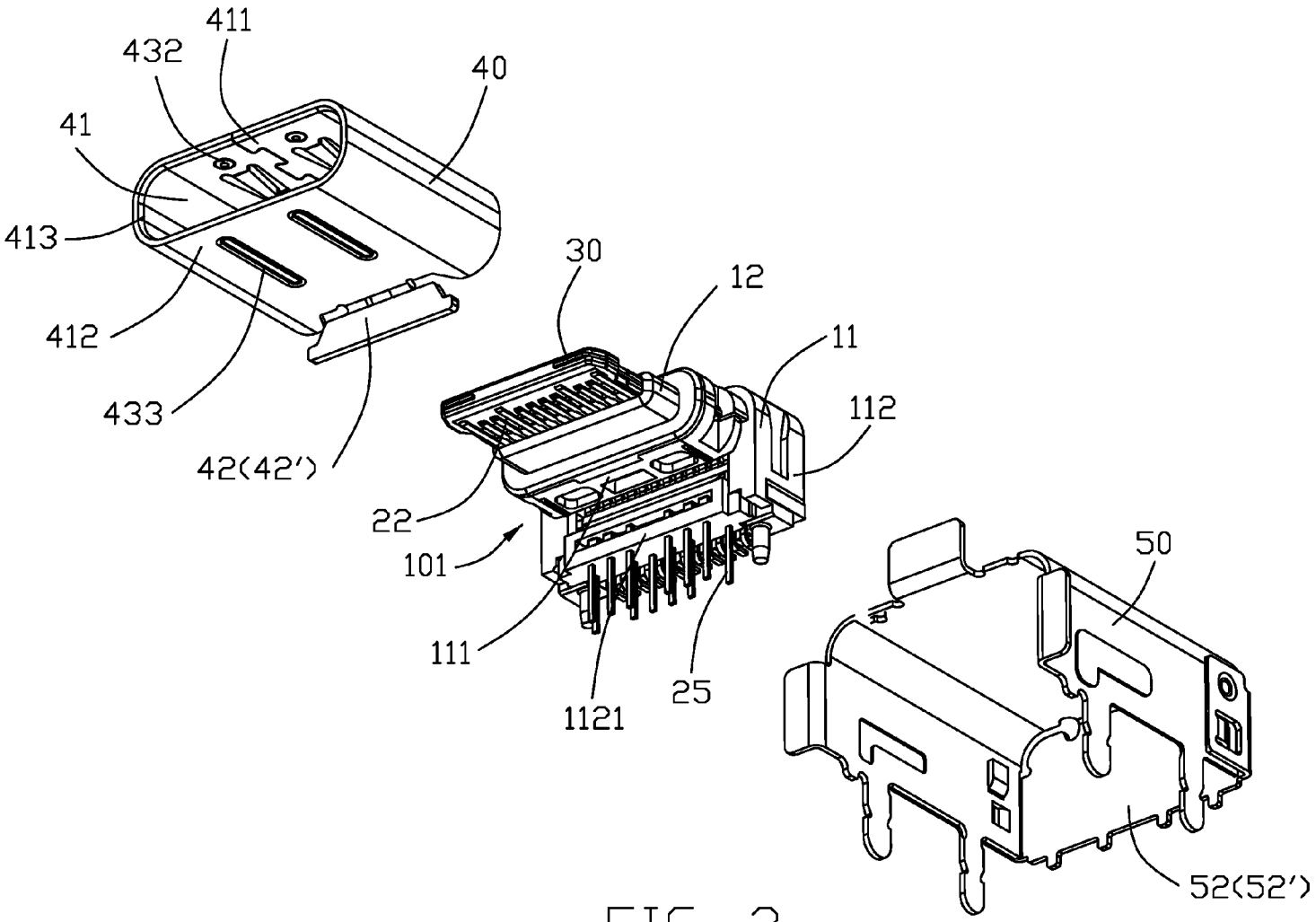
FIG. 3 is a further exploded perspective view of the electrical connector shown in FIG. 2.
Figure 4:
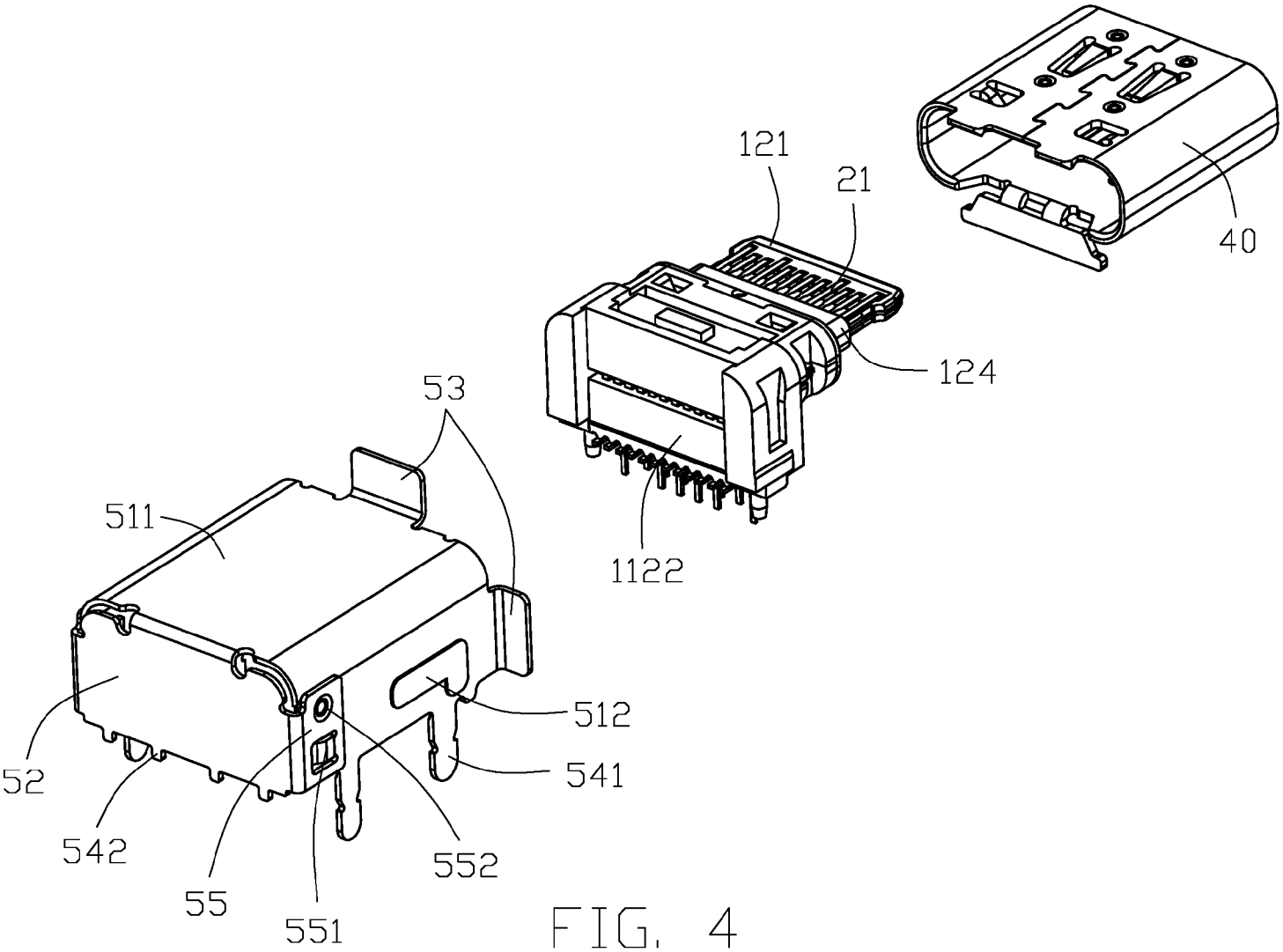
FIG. 4 is an another perspective view of the electrical connector shown in FIG. 3.
Figure 5:
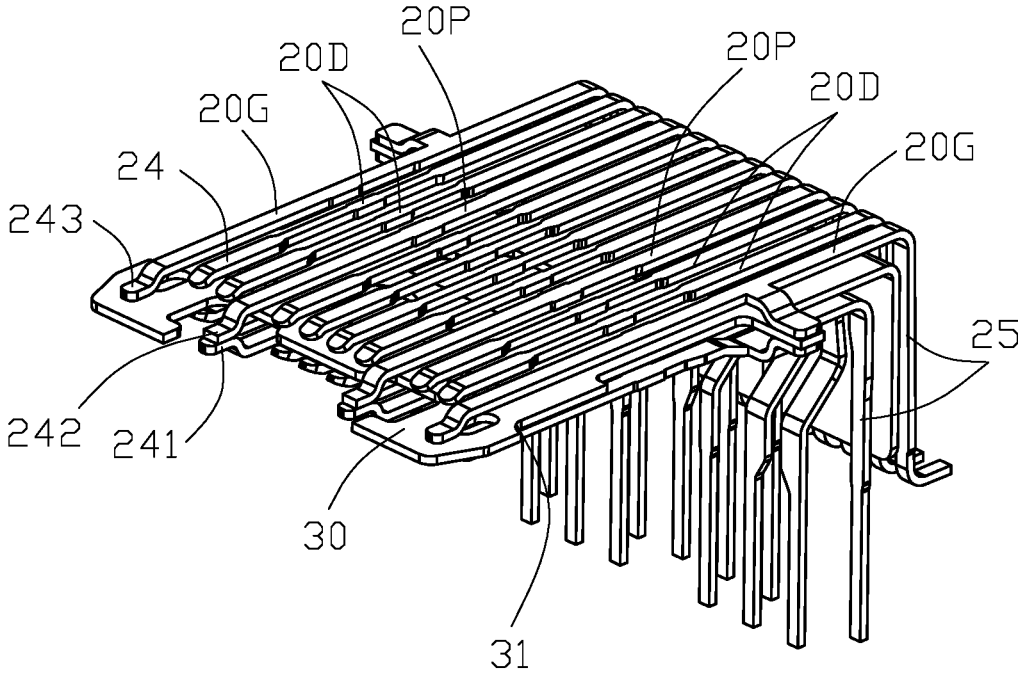
FIG. 5 is a perspective view of the contacts and the shielding plate of the electrical connector.
Figure 6:
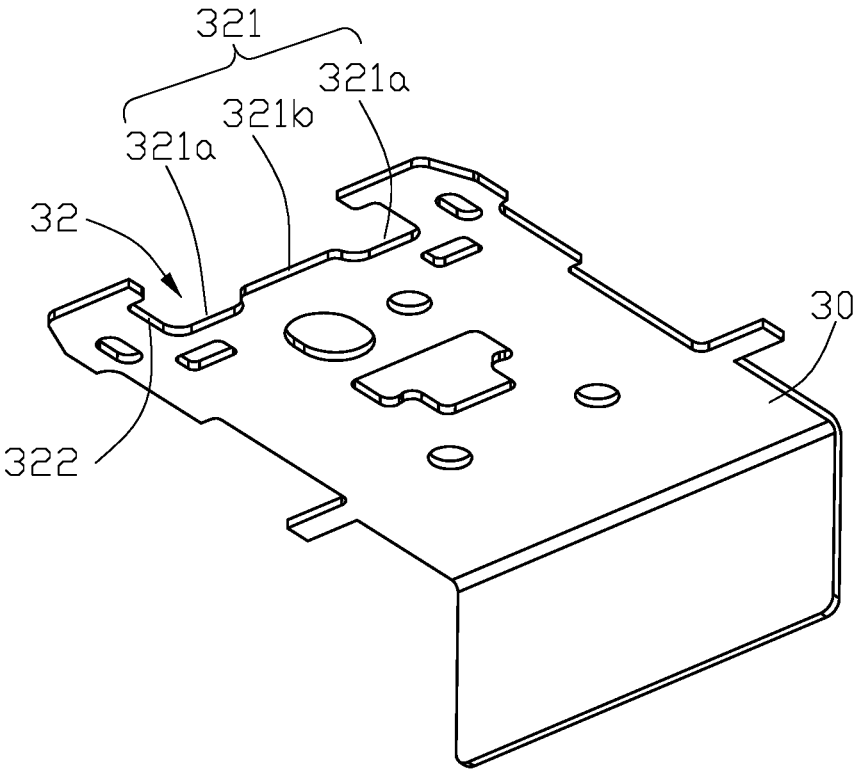
FIG. 6 is a perspective view of the shielding plate of the electrical connector.
Figure 7:
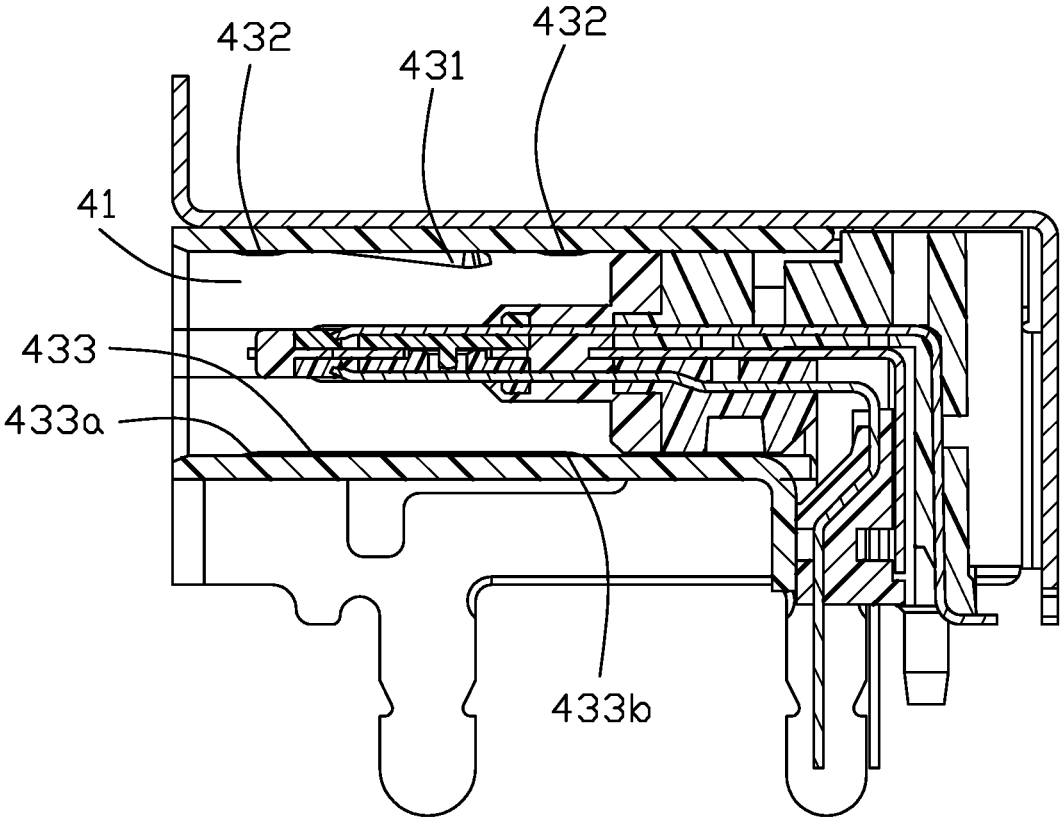
FIG. 7 is a cross-sectional view of the electrical connector to show the tails of the contacts are shielded between the front shielding member and the rear shielding member along the front-to-back direction.

Referring to FIG. 3 to FIG. 4, the mating tongue 12 defines two opposite mating surface 121, a row of first contacts 21 and a row of second contacts 22 with contacting portion 24 exposing to the mating surfaces 121 are provided. Combination with FIG. 5, each row of the contacts includes USB differential signal pair 20D, two power contacts 20P and two grounding contacts 20G. The contacts are flat, each flat contact comprises a contacting portion 24 and legs 25 extending from the base 11. The shielding plate 30 is disposed in the insulating housing 10 and between the two rows of the contacts 21, 22, with two side latches 31. The first contacts 21 and the second contacts 22 are aligned with each other one by one, and the mating cavity 41 are such defined that the electrical connector 100 can be inserted with a plug connector in either of two insertion orientations. The power contacts 20P of the second contacts 22 and the first contacts 21 comprise front distal ends 241, 242, the distal ends of the corresponding power contacts of the first and second contacts touch with each other and laser-welded together for further retention. The distal ends 241 of the power contacts of the second contacts 22 are shorter than the corresponding distal ends 241 of the power contacts of the first contacts 21, so that a size of the two welding distal ends 241, 242 will decrease, which reminds more room for insert-molded material of the housing 10. The front distal ends 243 of the grounding contacts 20G touch with the shielding plate 30 and are laser-welded with the shielding plate 30. Similarly, the side extension ends (not labeled) of the grounding contacts also touch the side extension (not labeled) of the shielding plate and are laser-welded thereon.

The shielding plate 30 defines a larger notch 32 at a front area thereof. The larger notch defines a rear edge 321 facing forwards and two opposite side edge 322, the rear edge 321 are divided to two side portions 321*a* and a middle portion 321*b*. The side ports 321*a* aligned with the distal ends of the power contacts, are behind the middle portion 321*b* and the side edge 322 space away from the power contacts with a larger gap, so that a compared larger space are disposed between the front distal ends of the power contacts 20P and the shielding plate 30. The larger space will speed heat radiation when the distal ends and the shielding plate 30 are laser welded.

It is noted that in the instant invention, the metallic shell 40 and the metallic bracket 50 are deemed as a metallic assembly surrounding the terminal module 101. The front shielding member and the rear shielding member is optimally formed by the metallic assembly.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing comprising a base and a mating tongue extending from the base, the mating tongue defining two opposite mating surfaces, the base comprises a retaining portion and a supporting portion extending downwards beyond the retaining portion, the supporting portion defining a front face and a rear face;

a plurality of contacts with contacting portions exposed on the opposite mating surfaces and legs extending downwards from the supporting portion;

a shielding plate disposed in the insulating housing and between the two mating surfaces, the shielding plate defining a pair of side latches at opposite lateral sides thereof;

a metallic shell retained on the retaining portion of the base and surrounding the mating tongue to define a mating cavity between the metallic shell and the mating tongue;

wherein the electrical connector further comprises a front shielding member intimately located in front of and covering the front face of the supporting portion and a rear shielding member intimately located behind and covering the rear face of the supporting portion for shielding the legs of the contacts in a front-to-back direction.

2. The electrical connector as claimed in claim 1, wherein the contacts are divided into two rows and each row at least comprises a power contact and a grounding contact, front distal ends of two power contacts of the two rows touch each other and are laser welded together.

3. The electrical connector as claimed in claim 2, wherein for the two power contacts of which the front distal ends are welded together, the front distal end of the power contact of one row extends forward beyond that of the power contact of the other row.

4. The electrical connector as claimed in claim 2, wherein front distal ends of the two grounding contacts touch the shielding plate and are laser welded to the shielding plate.

5. The electrical connector as claimed in claim 1, wherein the metallic shell comprises a top wall, a bottom wall and two sidewalls, and the front shielding member integrally extends from a rear edge of the bottom wall.

6. The electrical connector as claimed in claim 5, wherein the metallic bracket surrounding said metallic shell, and the rear shielding member extends from the metallic bracket.

7. The electrical connector as claimed in claim 6, wherein the metallic bracket comprises a top wall and two sidewalls, the rear shielding wall perpendicularly bends from a rear edge of the top wall of the metallic bracket.

8. The electrical connector as claimed in claim 5, wherein the top wall of the metallic shell defines two spring fingers slantwise extending into the mating cavity.

9. The electrical connector as claimed in claim 8, wherein the top wall defines two protruding dimples at a front point and a rear point respectively of the spring finger.

10. The electrical connector as claimed in claim 5, wherein the bottom wall of the metallic shell defines two protruding ribs extending into the mating cavity, the two protruding ribs are parallel to each other and each protruding rib extends in the front-to-back direction.

11. An electrical connector comprising:

an insulating housing comprising a base and a mating tongue extending from the base, the mating tongue defining a first mating surface and a second mating surface opposite to the first mating surface;

a row of first contacts at least comprising a power contact and a grounding contact, each first contact including a contacting portion exposed on the first mating surface and a leg extending from the base;

a row of second contacts at least comprising a power contact and a grounding contact, each second contact including a contacting portion exposed on the second mating surface and a leg extending from the base;

a shielding plate embedded in the insulating housing and disposed between the first contacts and the second contacts;

wherein front distal ends of the power contacts of the first and second contacts are touched each other and are laser-welded together.

12. The electrical connector as claimed in claim 11, wherein the front distal end of the power contact of the second contacts extends forward beyond the front distal end of the power contact of the first contacts.

13. The electrical connector as claimed in claim 11, wherein front distal ends of the grounding contacts of the first and second contacts touch the shielding plate and are laser welded to the shielding plate.

14. The electrical connector as claimed in claim 11, wherein the shielding plate defines a notch at a front edge thereof with a rear edge facing forwards and two side edges, the rear edge is divided into two side portions and a middle portion between the two side portions, the two side portions are defined to be behind the middle portion and the front distal ends of the power contacts extend in front of the side portion.

15. An electrical connector comprising:

an insulating housing comprising a base and a mating tongue extending from the base, the mating tongue defining a first mating surface and a second mating surface opposite to the first mating surface in a vertical direction;

a row of first contacts at least comprising a power contact and a grounding contact, each first contact including a contacting portion exposed on the first mating surface and a leg extending from the base;

a row of second contacts at least comprising a power contact and a grounding contact, each second contact including a contacting portion exposed on the second mating surface and a leg extending from the base;

a shielding plate embedded in the insulating housing and disposed between the first contacts and the second contacts;

wherein a distal end of the grounding contact of the first contacts cooperates with a distal end of the grounding contact of the second contacts to sandwich the metallic shielding plate therebetween in said vertical direction in a welded manner not only for electrical connection but also for mechanical reinforcement therebetween.

16. The electrical connector as claimed in claim 15, wherein each of said distal ends are located on both a front side and a lateral side of the housing.

17. The electrical connector as claimed in claim 15, wherein front distal ends of the power contacts of the first and second contacts are directly contacted with each other and welded together.

18. An electrical connector comprising:

an insulating housing comprising a base and a mating tongue extending from the base, the mating tongue defining a step root near to the base;

two rows of contacts including contacting portions exposed on opposite surfaces of the mating tongue and in front of the step root, and legs extending from the base;

a shielding plate embedded in the insulating housing and disposed between the two rows of contacts; and a metallic shell retained on the base portion and surrounding the mating tongue to define a mating cavity between the metallic shell and the mating tongue, the metallic shell comprising a top wall, a bottom wall and two sidewalls;

wherein the top wall of the metallic shell defines two spring fingers extending along a front-to-rear direction and slanting into the mating cavity, and for each spring fingers two protruding dimples is formed at a front point and a rear point respectively adjacent to each spring finger;

wherein the bottom wall define two protruding ribs extending into the mating cavity, and the two protruding ribs are parallel to each other and each protruding rib extends in the front-to-back direction.

19. The electrical connector as claimed in claim 18, wherein the two protruding ribs are vertically aligned with the corresponding spring fingers, respectively.

20. The electrical connector as claimed in claim 18, wherein the base comprises a retaining portion and a supporting portion extending downwards beyond the retaining portion and defining a front face and a rear face thereof, and a metallic front shielding member intimately covers the front face and a metallic rear shielding member intimately covers the rear face.

* * * * *